US005553557A

United States Patent [19]

Abdulally

[11] Patent Number: 5,553,557

[45] Date of Patent: Sep. 10, 1996

[54] METHOD OF DECREASING $NO_X$ EMISSIONS FROM A FLUIDIZED BED REACTOR

[75] Inventor: Iqbal F. Abdulally, Randolph, N.J.

[73] Assignee: Foster Wheeler Energy Corporation, Clinton, N.J.

[21] Appl. No.: 413,068

[22] Filed: Mar. 29, 1995

Related U.S. Application Data

[62] Division of Ser. No. 259,083, Jun. 13, 1994, Pat. No. 5,462,718.

[51] Int. Cl.[6] ..... F23T 11/00; F23T 15/00; F23D 1/00

[52] U.S. Cl. ..... 110/345; 110/215; 110/347; 110/245

[58] Field of Search ..... 110/215, 245, 110/344, 345, 347, 216, 348

[56] References Cited

U.S. PATENT DOCUMENTS

| | | | |
|---|---|---|---|
| 4,756,890 | 7/1988 | Tang et al. | 423/235 |
| 4,843,981 | 7/1989 | Goldbach et al. | 110/347 |
| 5,078,064 | 1/1992 | Breen et al. | 110/345 |
| 5,396,849 | 3/1995 | Boyd | 110/342 |
| 5,441,714 | 8/1995 | Oakes et al. | 110/345 X |

*Primary Examiner*—Henry A. Bennett
*Assistant Examiner*—Susanne C. Tinker
*Attorney, Agent, or Firm*—Warren B. Kice; Haynes and Boone

[57] ABSTRACT

A system and method are disclosed for lowering $NO_x$ levels in flue gases of a fluidized bed reactor using selective non-catalytic reduction. A reactor is connected to a separator by a duct, and a reactant is introduced into the duct for decreasing $NO_x$ levels in the flue gases passing from the reactor, through the duct, and into the separator. The reactant, such as ammonia or urea, is selectively injected into a gaseous-rich region of the duct, near an upper, inner portion of the duct, so that a high degree of mixing of the reactant with flue gases is achieved while maintaining a low degree of mixing of the reactant with the particulate materials. The point of injection of the reactant into the duct is also at a location nearer to the reactor than to the separator to provide for increased residence time. In this manner, the reactant is used efficiently while obtaining the desired lowering of $NO_x$ levels in the flue gases.

6 Claims, 1 Drawing Sheet

METHOD OF DECREASING $NO_x$ EMISSIONS FROM A FLUIDIZED BED REACTOR

This is a divisional of application Ser. No. 08/259,083 filed on Jun. 13, 1994 U.S. Pat. No. 5,462,718.

BACKGROUND OF THE INVENTION

This invention relates to a system and method of decreasing nitrogen oxides ("$NO_x$") emissions from a fluidized bed reactor. More particularly, this invention relates to the selective injection of a reactant into the reactor for reducing $NO_x$ levels in gaseous products of combustion in the reactor.

Fluidized bed combustion systems are well known and include a furnace section in which an oxygen-containing gas such as air is passed through a bed of particulate materials, including nitrogen-containing, carbonaceous fuel material, such as coal. Sorbent particles, such as limestone, lime, or dolomite may be added for the capture of oxides of sulfur generated during combustion. The oxygen-containing gas fluidizes the particulate materials in the furnace section and promotes the combustion of the particulate fuel material at a relatively low temperature. These types of combustion systems are often used in steam generators in which a cooling fluid, such as water, is passed through a fluid flow circuit in a heat exchange relationship to the fluidized bed reactor to generate steam and to permit high combustion efficiency, fuel flexibility, high sulfur adsorbtion, and relatively low $NO_x$ emissions.

A typical fluidized bed reactor utilized in the generation of steam is commonly referred to as a "bubbling" fluidized bed in which the fluidized particulate materials form a bed having a relatively high density and a well-defined or discrete upper surface. A more commonly used fluidized bed reactor is referred to as a "circulating" fluidized bed in which the fluidized particulate materials form a lower dense bed having a density below that of a typical bubbling fluidized bed and in which the primary gas has a fluidizing velocity which is equal to or greater than that of a bubbling bed. The primary gas passing through the lower dense bed entrains a substantial amount of fine particulate materials to form an upper dispersed bed of particulate materials, often to the extent that the primary gas is substantially saturated with the particulate materials in the dispersed bed.

It is generally considered desirable to operate these circulating fluidized beds using relatively high internal and external solids recycling so that they are insensitive to fuel heat release patterns, thus minimizing temperature variations and stabilizing the sulfur emissions at a low level. The high external solids recycling is achieved by disposing a separator, such as a cyclone separator, at the furnace section outlet to receive the flue gases, and the particulate materials entrained thereby, from the dispersed bed of the furnace section. The entrained particulate materials are separated from the flue gases in the separator, and the cleaned flue gases are passed to a heat recovery section while the separated particulate materials are recycled back to the furnace section. This recycling improves the efficiency of the separator, and the increased residence times of the fuel and sorbent particles result in more efficient use of the fuel and sorbent particles and, therefore, reduced consumption of the same.

Bubbling and circulating fluidized bed reactors also offer advantages in pollution control. For example, the emissions of $NO_x$ from fluidized bed reactors are relatively low compared to emissions from other conventional systems such as gas-fired systems and coal-fired power plants. To obtain even lower $NO_x$ emission levels, selective non-catalytic reduction ("SNCR") methods and selective catalytic reduction methods ("SCR") are employed. In SNCR methods, a reactant such as urea or ammonia, is injected into the reactor to react with the $NO_x$, forming $N_2$ and $H_2O$. The reactant is typically injected through numerous ports at various locations across the reactor including the furnace section, the separator, and the duct connecting the furnace section and separator. SNCR methods thereby allow even lower $NO_x$ emission levels to be obtained.

However, SNCR methods are not without problems. For example, inefficient utilization of the added reactant often prevents the SNCR methods from obtaining the desired degree of decrease in $NO_x$ levels. For more efficient usage of the reactant, it is desirable to have a high residence time of the reactant in the system, a high degree of mixing of the reactant with the $NO_x$-containing flue gases, and a low degree of mixing of the reactant with the particulate materials circulating in the system. Present systems often suffer from inefficient use of the reactant. For example, systems which inject the reactant into the furnace section and systems which inject the reactant into various locations across the duct may suffer from too much mixing of the reactant with the particulate materials and insufficient mixing of the reactant with the $NO_x$-containing flue gases. Similarly, systems which inject the reactant into the separator may suffer from insufficient residence time and from insufficient mixing of the reactant with the $NO_x$-containing flue gases.

Inefficient utilization of the reactant results in excessive use of the reactant which adds to the cost of the SNCR method. Additionally, adding excessive amounts of reactant can generate new pollution problems.

SUMMARY OF THE INVENTION

It is therefore an object of the present invention to provide a method of operating a fluidized bed reactor in which $NO_x$ emission levels are lowered.

It is a further object of the present invention to provide a method of operating a fluidized bed reactor in which $NO_x$ emission levels are lowered using a selective non-catalytic reduction method.

It is a still further object of the present invention to provide such a method in which a reactant is efficiently used to decrease $NO_x$ emission levels in gaseous products of combustion.

It is a still further object of the present invention to provide a method of the above type which permits increased residence time of the reactant, increased mixing of the reactant with gaseous products of combustion, and decreased mixing of the reactant with particulate materials to provide for highly efficient use of the reactant.

It is a still further object of the present invention to provide a system and method of the above type in which particular location for efficiently decreasing $NO_x$ a reactant is selectively injected into the system at a emission levels in gaseous products of combustion.

Toward the fulfillment of these and other objectives, the method of the present invention permits the lowering of $NO_x$ levels in flue gases from a fluidized bed reactor through selective non-catalytic reduction. A reactor is connected to a separator by a duct, and a reactant is introduced into the duct for decreasing $NO_x$ levels in the flue gases passing from the reactor, through the duct, and into the separator. The reactant, such as ammonia or urea, is injected into a gaseous-rich region of the duct, near an upper, inner portion of the duct, so that a high degree of mixing of the reactant with flue gases is achieved while maintaining a low degree of mixing of the reactant with the particulate materials. The reactant is also injected into the duct at a point nearer to the reactor than to the separator to provide for increased residence time. In this manner, the reactant is used efficiently while obtaining the desired lowering of $NO_x$ levels in the flue gases.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
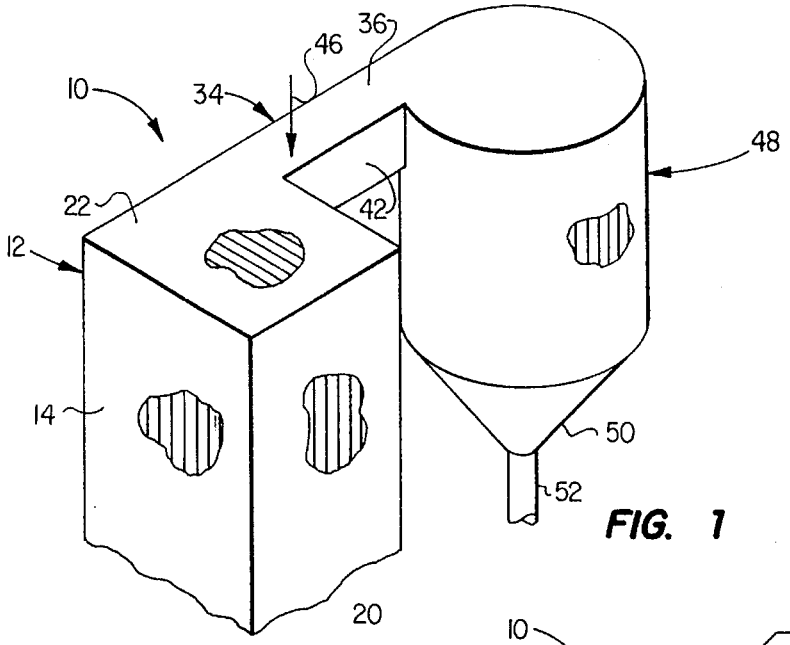
FIG. 1 is a schematic, elevational view of a portion of a fluidized bed combustion system for practicing the present invention.
Figure 2:
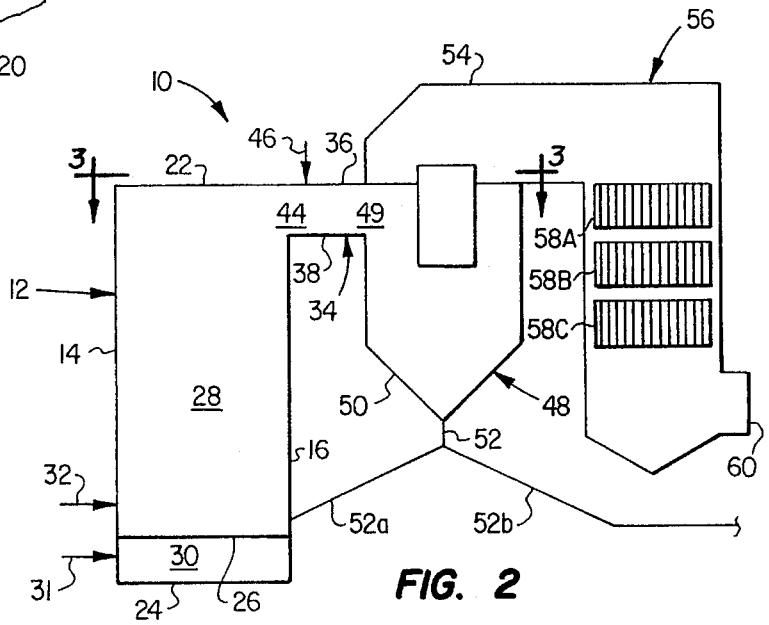
FIG. 2 is a schematic, side elevational view of a fluidized bed combustion system for practicing the present invention.
Figure 3:
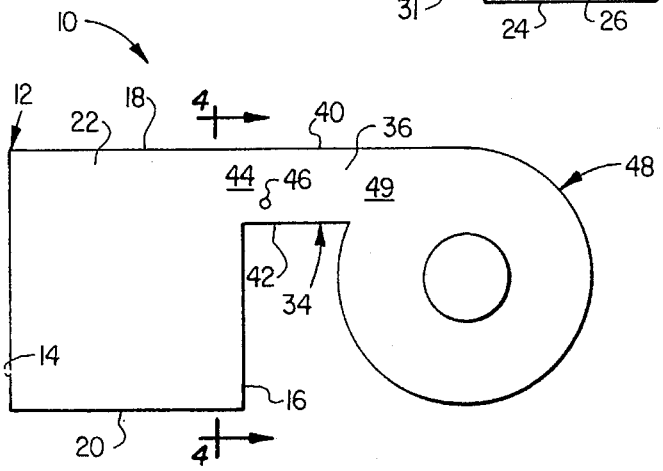
FIG. 3 is an enlarged, schematic, plan view taken along the line 3—3 of FIG. 2.
Figure 4:
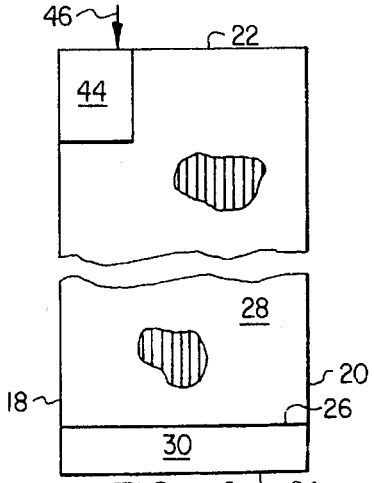
FIG. 4 is an elevational view of the system of FIGS. 2 and 3, taken along the line 4—4 of FIG. 3.

Referring to FIGS. 1–3, the reference numeral 10 refers in general to a fluidized bed reactor used for the generation of steam. The reactor 10 includes an enclosure 12 having a front wall 14, a spaced, parallel rear wall 16, two spaced side walls 18 and 20 (FIG. 3) which extend perpendicular to the front and rear walls, a roof 22, and a floor 24, which together form a substantially rectangular enclosure.

A lower portion of the enclosure 12 is divided by a perforated distribution plate 26 into a furnace section 28 and a plenum chamber 30. The distribution plate 26 is suitably supported at the lower portion of the enclosure 12 and supports a bed of particulate materials which may include nitrogen-containing carbonaceous fuel particles, such as coal, for combustion; sorbent particles, typically a calcium-containing sulfur acceptor such as limestone, lime, or dolomite, for the capture of $SO_X$ released during combustion of the fuel particles; and solid products of combustion.

A conduit 31 supplies the plenum chamber 30 with a fluidizing, oxygen-containing gas such as air from a conventional, suitable source (not shown), such as a forced-draft blower or the like. The fluidizing gas introduced into the plenum chamber 30 passes in an upward direction through the distribution plate 26 to support combustion and to fluidize the particulate materials in the furnace section 28.

A conduit 32 supplies the furnace section 28 with particulate materials which may include nitrogen-containing particulate fuel material, such as coal, and sorbent particles. It is understood that more than one conduit 32 may be used and any number of arrangements for providing fuel and sorbent particles to the furnace section 28 of the enclosure 12 may be used. Examples of a few arrangements that may be used are disclosed in U.S. Pat. No. 4,936,770, assigned to the assignee of the present invention, the disclosure of which is hereby incorporated by reference.

A duct 34 is connected to the rear wall 16 of the enclosure 12 near the roof 22 and side wall 18. As best shown in FIGS. 2 and 3, the duct has a roof or top wall 36, a floor or bottom wall 38, an outer wall 40 and an inner wall 42. The duct 34 is disposed so that the outer wall 40 is aligned with and falls in the same vertical plane as the side wall 18 of the enclosure 12, and so that the top wall 36 is aligned with and falls in the same horizontal plane as the roof 22 of the enclosure 12. An opening 44 in the rear wall 16 of the enclosure 12 places the duct 34 in gas flow communication with the furnace section 28 of the enclosure 12. For reasons to be described, a port 46 is provided for injecting a reactant into an upper portion of the duct 34 through the top wall 36 of the duct. The port 46 is located near the opening 44 in the rear wall 16 of the enclosure 12 and is also located closer to the inner wall 42 of the duct 34 than to the outer wall 40 thereof. Although the duct 34 depicted and described is subtantially rectangular, the duct 34 may have any number of shapes, including but not limited to a cylindrical configuration.

A cyclone separator 48 extends adjacent to the enclosure 12 and is connected thereto by the duct 34 which extends to an upper portion of the separator 48. An opening 49 in an outer wall of the separator 48 places the duct 34 in gas flow communication with the separator 48 so that flue gases and particulate materials may pass from the enclosure 12, through the duct 34, and into the separator 48. The lower portion of the separator 48 includes a conically shaped hopper section 50 which is connected at its lower end to a conduit 52 which has a branch conduit **52*a* extending back to the enclosure 12 and a branch conduit 52*b*** extending externally from the separator.

The separator 48 receives flue gases and entrained particulate materials from the furnace section 28 and operates in a conventional manner to disengage the entrained particulate materials from the flue gases. The separated particulate materials fall to the hopper section 50 of the separator 48 and pass to the conduit 52 for recycle to the furnace section 28, via the branch conduit **52*a*, or for disposal via the branch conduit 52*b*. Although reference is made to one separator 48, it is understood that one or more additional separators (not shown) may be used with the reactor 10. The number and size of separators 48** used is determined by the capacity of the steam generator and economic considerations.

The separated flue gases, which are substantially free of particulate materials, pass via a duct 54, located immediately above the separator 48, into a heat recovery section shown in general by the reference numeral 56. A plurality of heat exchange surfaces 58A, 58B, 58C are disposed in the heat recovery section 56, all of which are formed by a plurality of heat exchange tubes which extend in the path of the separated flue gases as the separated flue gases pass through the heat recovery section 56. The heat exchange surfaces 58A, 58B, 58C may serve as reheaters, superheaters, economizers, or the like, as desired. After passing across the heat exchange surfaces 58A, 58B, 58C, the separated flue gases exit the heat recovery section 56 through outlet 60.

The walls of the enclosure 12, the duct 34, the separator 48, and the heat recovery section 56 are preferably formed by a plurality of spaced, parallel tubes interconnected by fins to form contiguous airtight structures. Since this type of structure is conventional, it will not be shown or described in further detail. The ends of each of these finned tubes are connected to a plurality of horizontally disposed upper and lower headers (not shown), respectively.

A steam drum (not shown) is located above the enclosure 12, the duct 34, the separator 48, and the heat recovery section 56. The steam drum receives a cooling fluid such as water from a feed pipe, and a plurality of downcomers and pipes extend from the steam drum and are utilized, along with connecting feeders, risers, headers, etc., to establish a fluid flow circuit which includes the finned tubes forming the aforementioned walls and the heat exchange surfaces 58A, 58B, 58C in the heat recovery section 56. Water may be passed in a predetermined sequence through this fluid flow circuitry to convert the water to steam and to heat the steam with the heat generated by the combustion of the fuel particles.

In operation, particulate materials, including nitrogen-containing carbonaceous fuel particles, such as coal, and sorbent particles, typically a calcium-containing sulfur acceptor such as limestone, lime, or dolomite, are introduced into the furnace section 28 via the conduit 32 (FIG. 2). An oxygen-containing gas, such as air, from an external source is introduced at a relatively high pressure via the conduit 31 into the plenum chamber 30 and is passed upwardly through the distribution plate 26 at a relatively high fluidizing velocity to fluidize the particulate materials in the furnace section 28. A light-off burner (not shown) or the like ignites the fuel particles, and thereafter the fuel particles are self-combusted by the heat in the furnace section 28, thereby generating gaseous and solid products of combustion.

The velocity of the fluidizing gas is then controlled to maintain a dense bed of particulate materials in a lower portion of the furnace section 28 and to pass or entrain an amount of the particulate materials upwardly from the dense bed to form a dispersed bed above the dense bed.

The fluidizing gas mixes with the gaseous products of combustion to form flue gases which pass upwardly through the upper region of the furnace section 28 with the entrained particulate material. The flue gases and at least a portion of the entrained particulate materials pass from the furnace section 28, through the duct 34, and to the separator 48. In the separator 48, the particulate materials are separated from the flue gases and fall to the hopper section 50 of the separator 48 before passing to the conduit 52 for recycle to the furnace section 28, via branch conduit 52*a*, or for disposal via the branch conduit 52*b*.

The separated flue gases exit the separator 48 via the duct 54 and pass to a heat recovery section 56. In the heat recovery section 56, the separated flue gases pass through the heat exchange surfaces 58A, 58B, 58C before exiting via outlet 60.

Water is passed through the feed pipe to the steam drum and is then passed through the fluid flow circuit so that the heat generated by combustion is used to convert the water to steam and to superheat the steam.

As the flue gases, with the entrained particulate materials, pass from the furnace section 28, through the opening 44, and into the duct 34, the particulate materials tend to move toward an upper, outer portion of the duct 34, whereas the flue gases, including undesired $NO_x$, tend to be concentrated more toward an upper, inner portion of the duct. Due to this action, a gaseous-rich region is formed in the upper, inner portion of the duct.

A reactant for lowering $NO_x$ levels, such as ammonia or urea, is selectively injected into the gaseous-rich region of the duct. The reactant is typically chosen for its ability to provide an $NH_2$ radical which, through a series of complex reactions, reacts with the $NO_x$ to yield $N_2$ and $H_2O$. The reactant is injected into the gaseous-rich region of the duct 34, in an upper portion of the duct nearer to the inner wall 42 of the duct 34 than to the outer wall 40 of the duct 34, to provide a high degree of mixing of the reactant with the flue gases, including $NO_x$, while avoiding a high degree of mixing of the reactant with the particulate materials in the upper, outer portion of the duct 34. The point of injection of the reactant into the duct 34 is also at a location near the opening 44 to provide for increased residence time of the reactant. The high degree of mixing of the reactant with the flue gases, the low degree of mixing of the reactant with the particulate materials, and the high residence time of the reactant in the system allow for efficient use of the reactant while obtaining a large decrease in $NO_x$ levels in the flue gases.

Several advantages result from the foregoing method. For example, emissions of $NO_x$ are lowered while making efficient use of expensive reactants. Also, problems associated with excessive reactant use are also avoided. The selective injection of the reactant is also advantageous from the standpoint of ease and cost of fabrication and operation.

It is understood that variations may be made in the method of the present invention without departing from the scope of the present invention. For example, the injection point of the reactant may be in any number of locations along the duct 34, as long as the reactant is injected into a gaseous-rich region of the duct 34 near an upper, inner portion of the duct 34. In that regard, the injection port 46 may pass through the upper 36, lower 38, outer 40, or inner 42, walls of the duct 34 and may extend into the duct 34 or terminate in a duct wall. Although it is preferred that the duct 34 be formed by finned, cooling tubes, the duct 34 may be of any conventional construction. Additionally, the separator 48 may, but need not, be a cyclone separator, and one or more separators may be associated with the furnace section. Although only a single source of fluidizing gas is discussed in the detailed description, it is understood that the method and system of the present invention may be used in connection with multi-staged combustion in which fluidizing and combustive gases may be introduced into the furnace section at various locations and at various levels.

Other modifications, changes, and substitutions are intended in the foregoing disclosure and, in some instances, some features of the invention can be employed without a corresponding use of other features. Various modifications to the disclosed embodiment as well as alternative applications of the invention will be suggested to persons skilled in the art by the foregoing specification and drawing. Accordingly, it is appropriate that the appended claims be construed broadly and in a manner consistent with the scope of the invention therein.

What is claimed is:

1. A combustion method for decreasing $NO_x$ emissions, the method comprising the steps of:

introducing fuel particles into an enclosure;

combusting the fuel particles material in the enclosure;

introducing an oxygen-containing, fluidizing gas into the enclosure to support combustion of the fuel particles and to fluidize the fuel particles so that the fluidizing gas combines with gaseous products of combustion to form flue gases that entrain a portion of the fuel particles and pass upwardly through the enclosure;

providing a duct in an upper portion of the enclosure in gas flow communication with the enclosure, the duct having an upper portion, a lower portion, and two side portions;

locating the duct relative to the enclosure so, as the flue gases pass through the duct, they tend to pass closer to one side portion thereof than the other side portion; and so, as the fuel particles pass through the duct, they tend to pass closer to the other side portion than the one side portion; and injecting a reactant into the duct nearer to the one side portion than to the other side portion for decreasing $NO_x$, levels in the flue gases passing through the duct.

2. The method of claim 1 wherein the flue gases tend to pass through the upper portion of the duct and wherein the reactant is injected into the upper portion of the duct.

3. The method of claim 1 further comprising the steps of connecting one end of the duct to the enclosure and connecting the other end of the duct to a separator so that the enclosure, the duct and the separator are in gas flow communication so that the flue gases and the fuel particles pass from the duct into the separator.

4. The method of claim 3 wherein the reactant is selectively injected nearer to the end of the duct adjacent the enclosure than to the other end thereof.

5. The method of claim 1 wherein the reactant comprises a material containing an $NH_2$ radical.

6. The method of claim 1 wherein the reactant is selected from the group consisting of urea and ammonia.

* * * * *

UNITED STATES PATENT AND TRADEMARK OFFICE

CERTIFICATE OF CORRECTION

PATENT NO. : 5,553,557

DATED : September 10, 1996

INVENTOR(S) : Iqbal F. Abdulally

It is certified that error appears in the above-indentified patent and that said Letters Patent is hereby corrected as shown below:

Col. 1, line 10, delete "system and" after "a".

Col. 2, line 57, delete "system and" after "a".

Col. 2, line 58, before "particular" insert --a reactant is selectively injected into the system at a--.

Col. 2, line 58, delete "a reactant" after "NOx".

Col. 2, line 59, delete "is selectively injected into the system at a" before "emission".

Signed and Sealed this

Twenty-fourth Day of December, 1996

*Attest:*

Bruce Lehman

BRUCE LEHMAN

*Attesting Officer*

*Commissioner of Patents and Trademarks*